US007537251B1

(12) United States Patent
Profita

(10) Patent No.: US 7,537,251 B1
(45) Date of Patent: May 26, 2009

(54) SLIDING DOOR LOCK

(76) Inventor: Charles Profita, P.O. Box 14301, Scottsdale, AZ (US) 85267

( * ) Notice: Subject to any disclaimer, the term of this patent is extended or adjusted under 35 U.S.C. 154(b) by 41 days.

(21) Appl. No.: 11/387,031

(22) Filed: Mar. 21, 2006

Related U.S. Application Data

(60) Provisional application No. 60/663,954, filed on Mar. 21, 2005.

(51) Int. Cl.
*E05C 17/54* (2006.01)

(52) U.S. Cl. ..... 292/339; 292/DIG. 46

(58) Field of Classification Search ..... 292/DIG. 46, 292/339, 343; 49/449
See application file for complete search history.

(56) References Cited

U.S. PATENT DOCUMENTS 1,598,583 A * 8/1926 Cook ..... 49/359
1,921,568 A * 8/1933 Hasselberger ..... 292/344
3,124,382 A * 3/1964 Strother ..... 292/343
3,816,967 A * 6/1974 Littrell ..... 49/449
4,792,168 A * 12/1988 Kardosh ..... 292/288
5,127,689 A * 7/1992 Jarvis ..... 292/339
5,294,159 A * 3/1994 Corrigan ..... 292/258
2006/0053693 A1 * 3/2006 Sullivan ..... 49/168

* cited by examiner

*Primary Examiner*—Gary Estremsky
(74) *Attorney, Agent, or Firm*—Schmeiser, Olsen & Watts LLP

(57) ABSTRACT

A sliding door lock includes a track lock having a predetermined length, wherein the track lock fits within a sliding door track. The sliding door lock also includes a handle having a first end and an opposing second end. The first end is hingedly coupled to an end of the track lock. The handle is rotatable between a closed position with the handle substantially parallel to the track lock and an opened position with the handle substantially perpendicular to the track lock. The sliding door lock prevents opening of a sliding door while the lock is in the sliding door track.

8 Claims, 2 Drawing Sheets

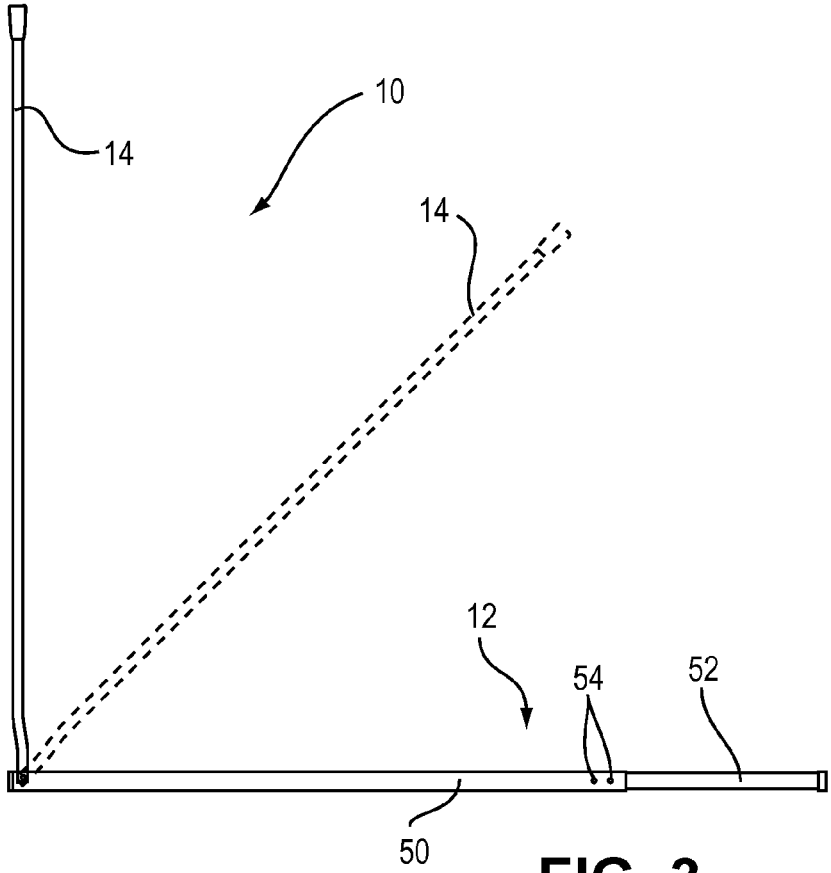
FIG. 3
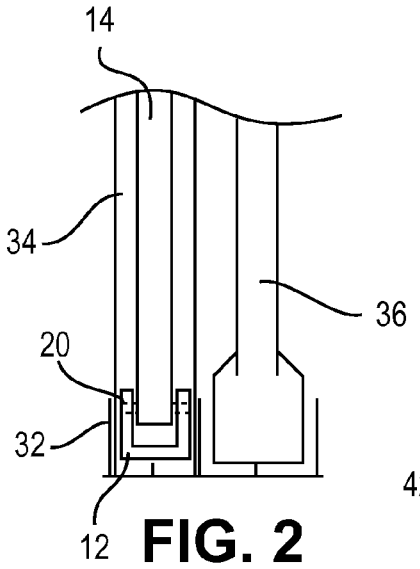
FIG. 2
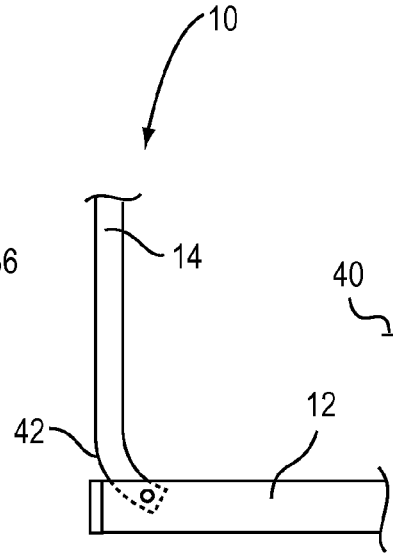
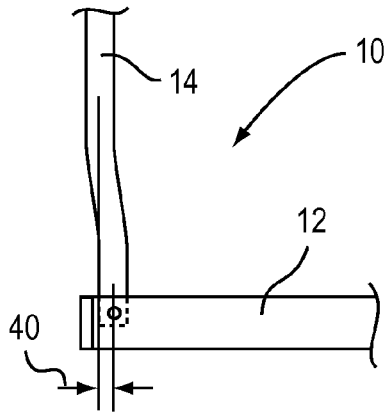
FIG. 4a
FIG. 4b

SLIDING DOOR LOCK

CROSS REFERENCE TO RELATED APPLICATION

This application claims priority to U.S. Provisional Patent Application Ser. No. 60/663,954, filed Mar. 21, 2005 by Charles Profita, the disclosures of which are hereby incorporated entirely herein by reference.

BACKGROUND OF THE INVENTION

1. Technical Field

This invention relates generally to door locks and more particularly to sliding door locks.

2. State of the Art

Sliding doors commonly have two portions or panels. The first panel is fixed within the sliding door frame and the second panel is parallel to the first panel and slides along a sliding door track to allow for opening and closing of the door. Conventionally, sliding doors have a latch or hook which engage a portion of the frame to lock the sliding door in a closed position. The latch is often weak and not effective at preventing the opening of the door when larger forces are applied to the door to disengage the latch.

Conventional locking device employed to the reinforce the locking of sliding doors include bolts that engaged the frame and the sliding panel and rods or bars placed within the sliding door track. These conventional devices have their limitations.

Bolts are often mounted to the frame and require modifying or mounting a separate bracket and or drilling a hole within the frame. When the bolt is engaged, the bolt prevents the sliding panel from sliding, thereby locking the sliding door. The mounting of such a lock has its limitations, such as having to modify the existing frame to mount the lock. Further, in cases of emergency or the need for quick egress, it is difficult to disengage the lock quickly. Additionally, this type of bolt lock often is often damaged and creates difficulty in engaging and disengaging the lock.

Rods and bars are often sized to the particular door and placed within the bottom of the sliding door track. This prevents the door from sliding open. These too have limitations including the speed of egress, in such instances such as fire or other need for quick egress.

Accordingly, there is a need in the field of sliding door locks for an improved sliding door lock.

DISCLOSURE OF THE INVENTION

The present invention relates to a sliding door lock that prevents opening of a sliding door while the sliding door lock is in a sliding door track.

An aspect of the present invention includes a sliding door lock comprising a track lock having a predetermined length, wherein the track lock fits within a sliding door track, and a handle having a first end and an opposing second end, the first end hingedly coupled to an end of the track lock, wherein the handle is rotatable between a closed position and an opened position.

Another aspect of the present invention includes a sliding door lock comprising a track lock, wherein the track lock is telescopically extendable and fits within a sliding door track; a detent coupled to the track lock to lock the telescopic movement of the track lock; end pieces are coupled to the ends of the track lock to cover the ends of the track lock, wherein the end pieces are compressible to account for variations of sizes of at least one of sliding door track size and sliding door track length; and a handle having a first end and an opposing second end, the first end hingedly coupled to an end of the track lock, wherein the handle is rotatable between a closed position and an opened position.

Yet, another aspect of the present invention includes a sliding door lock comprising a track lock having a predetermined length for use with at least one sliding door sized within the range of 36 to 72 inches, wherein the track lock fits within a sliding door track; end pieces coupled to the ends of the track lock to cover the ends of the track lock, wherein the end pieces are compressible to account for variations of sizes of at least one of sliding door track size and sliding door track length; a grip coupled to the second end of the handle, wherein the grip allows easy holding and removing of the sliding door lock from the sliding door track; and a handle having a first end and an opposing second end, the first end hingedly coupled to an end of the track lock, wherein the handle is rotatable between a closed position and an opened position.

The foregoing and other features and advantages of the present invention will be apparent from the following more detailed description of the particular embodiments of the invention, as illustrated in the accompanying drawings.

BRIEF DESCRIPTION OF THE DRAWINGS

FIG. 2 is an end view of a sliding door lock in a sliding door track, in accordance with the present invention;

FIG. 3 is a side view of a sliding door lock, in accordance with the present invention;

FIG. **4*a* is a side view of a portion of the sliding door lock, in accordance with the present invention; and FIG. 4*b*** is a side view of a position of the sliding door lock in accordance with the present invention.

DETAILED DESCRIPTION OF EMBODIMENTS OF THE INVENTION

Figure 1:
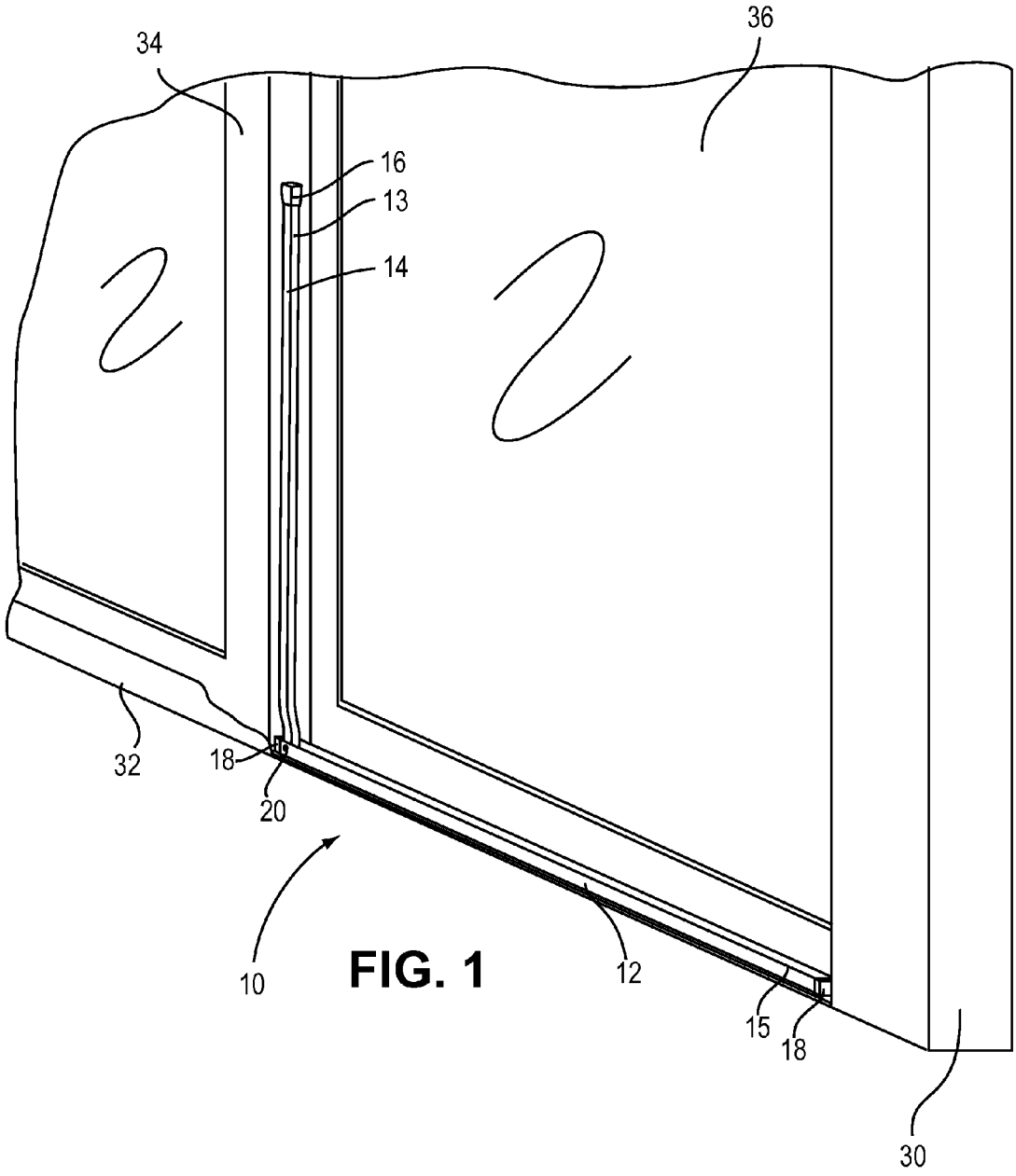
FIG. 1 is a perspective view of a sliding door lock in a sliding door track, in accordance with the present invention.

As discussed above, embodiments of the present invention relate to a sliding door lock that prevents opening of a sliding door while the sliding door lock is in a sliding door track. Generally, a sliding door lock, according to embodiments of the present invention, comprises a track lock and a handle.

As shown in FIGS. 1 and 2, particular embodiments of the present invention include a sliding door lock 10. The door lock 10 comprises a track lock 12 and a handle 14 having a first end 13 and a second opposing end 15. The first end 13 of the handle 14 may be coupled to the track lock 12 by use of a hinge point 20. The handle 14 is rotatable about the hinge point 20. The handle 14 is rotatable from a closed position wherein the handle 14 is substantially parallel to the track lock 12 to an opened position wherein the handle 14 is substantially perpendicular to the track lock 12. It will be understood by those of ordinary skill in the art the hinge point 20 may be any type of hinge point, such as, but not limited to, a bolt, a screw, a rod, a shaft, a dowel, and any combination thereof. Further the track lock 12 may be a predetermined length for use with at least one sliding door sized within the range of 36 to 72 inches.

The door lock 10 may further comprise a grip 16 coupled to the second end of the handle 14. The grip 16 may allow for easy holding and removing of the sliding door lock from a sliding door track 32. The grip 16 can be any structure that makes it easier to grasp the handle 14 and lift it to disengage the track lock 12 from its locked position in the door track 32.

Handle 14 can also be used to make it easier to insert the lock 12 into the door track 32. The door lock 10 may also comprise end pieces 18, wherein the end pieces 18 are coupled to ends of the track lock 12. The end pieces 18 may be compressible to account for variations of sizes of at least one of sliding door track size and sliding door track length. The end pieces 18 may further provide a protection to the sliding door from being marred, scratched, dented or otherwise damages when coming in contact with the track lock 12.

With further reference to FIGS. 1 and 2, a sliding door lock 10 may be used with a sliding door having a frame 30, a sliding door track 32, a sliding door 34 and a stationary panel 36. The track lock 12 of the sliding door lock 10 may be placed in the sliding door track 32 adjacent the stationary panel 36, wherein the track lock 12 is substantially horizontal. The handle 14 may be rotated into the opened position with the handle 14 substantially perpendicular to the track lock 12 and adjacent to and contacting an end of the sliding door 34. The track lock 12 serves to prevent the opening of the sliding door 34 by limiting the travel of the door 34 within the sliding door track 32. The handle 14 when rotated into the opened position, allows a user to easily grasp the handle 14 and lift the track lock 12 out of the sliding door track 32, thereby disengaging the lock and allowing egress through the sliding door 34.

Referring further to the drawings, FIG. 3 depicts a side view of a sliding door lock 10 in accordance with the present invention. The sliding door lock 10 comprises a sliding door track 12 and a handle 14. The handle 14 may be rotated from a closed position wherein the handle 14 is substantially parallel with the track lock 12. As shown if FIG. 3, the handle 14 may be rotated through several positions. It will be understood that particular embodiments of the present invention may limit the range of motion of the handle to approximately 90 degrees of rotation about hinge point 20.

The track lock 12 may also be telescopically extendable and comprise an outer portion 50 and an inner portion 52. The inner portion 52 may be extended from the outer portion 50 to various lengths. In particular embodiments, the lengths to which the track lock 12 may be sufficient to be used with sliding doors sized within a range of approximately 36 inches to approximately 72 inches, thereby being useable for three foot doors, four foot doors and five foot doors. The door lock 10 may further comprise a detent 54 for locking the inner portion to the outer portion at a particular length. The detent 54 may be any type of locking device, such as a pin, a rod, a shaft, a clamp, a clip, and any type of lock that will retain the track lock 24 at a particular length.

Referring again to the drawings, FIGS. 4*a* and 4*b* depict a side view of a portion of a sliding door lock 10 in accordance with the present invention. In particular embodiments, the sliding door lock may have a handle 14 with an offset 40. The offset 40 allows the handle 14 to contact an edge of a sliding door, thereby placing the handle in a substantially perpendicular position to the track lock 12. Alternatively, the handle may have a curved portion 40 shown in broken lines that also allows the handle 14 to be rotated into a substantially perpendicular position to the track lock 12.

The track lock 12 may further be a U-shaped channel that allows the handle 14 to be rotated until it rests within the track lock 12 when in the closed position. Other embodiments include those that employ curved portion 42, the track lock 12 may be a tube, wherein the handle 14 is not rotated within the track lock 12, but rather is rotated into a position adjacent to and substantially parallel with the track lock 12.

It will be understood by those of ordinary skill in the art that while it is shown that the sliding door lock utilizes square tubing and/or channels, the tubing and/or channel shapes are not limited to a square in cross-section. Any cross-sectional tube and/or channel may be utilized, including, but not limited to a triangle, a circle, a rectangle, and any other rectilinear shape.

The components defining any embodiment of a sliding door lock in accordance with the present invention may be formed of any of many different types of materials or combinations thereof that can readily be formed into shaped objects provided that the components selected are consistent with the intended operation of a sliding door lock. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of a sliding door lock in accordance with the present invention may be purchased pre-manufactured or manufactured separately and then assembled together. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While it has been shown that the sliding door lock is used with sliding doors, it may be used on other structures. For example and without limitation, embodiments of the present invention may be used with sliding windows.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A sliding door lock arranged in a sliding door track comprising:

a track lock, wherein the track lock is telescopically extendable and fits within the sliding door track;

a detent coupled to the track lock to lock the telescopic movement of the track lock;

end pieces coupled to the ends of the track lock to cover the ends of the track lock, wherein the end pieces are compressible to account for variations of sizes of at least one of sliding door track size and sliding door track length; and a handle having a first end and an opposing second end, the first end hingedly coupled to an end of the track lock, wherein the handle is rotatable between a closed position and an opened position; is collinear with the track lock when the handle is in the closed position; and comprises a curved portion.

2. The sliding door lock of claim 1, wherein the handle is substantially perpendicular to the track lock when the handles is in the opened position.

3. The sliding door lock of claim 1, wherein the track lock is extendable for use with sliding doors sized within the range of 36 to 72 inches.

4. The sliding door lock of claim 1, further comprising a grip coupled to the second end of the handle, wherein the grip allows for easy holding and removing of the sliding door lock from the sliding door track.

5. A sliding door lock arranged in a sliding door track comprising:

a track lock, wherein the track lock is telescopically extendable and fits within the sliding door track;

a detent coupled to the track lock to lock the telescopic movement of the track lock;

end pieces coupled to the ends of the track lock to cover the ends of the track lock, wherein the end pieces are compressible to account for variations of sizes of at least one of sliding door track size and sliding door track length; and a handle having a first end and an opposing second end, the first end hingedly coupled to an end of the track lock, wherein the handle is rotatable between a closed position and an opened position; is substantially parallel with the track lock when the handle is in the closed position; and comprises a curved portion.

6. The sliding door lock of claim 5, wherein the handle is substantially perpendicular to the track lock when the handle is in the opened position.

7. The sliding door lock of claim 5, wherein the track lock is extendable for use with sliding doors sized within the range of 36 to 72 inches.

8. The sliding door lock of claim 5, further comprising a grip coupled to the second end of the handle, wherein the grip allows for easy holding and removing of the sliding door lock from the sliding door track.

* * * * *